United States Patent [19]

DeCanio

[11] Patent Number: 4,927,439

[45] Date of Patent: May 22, 1990

[54] COOLING TOWER OVERFLOW DRAIN CAP

[76] Inventor: Paul J. DeCanio, 49 Greis Ave., LK Ronkonkoma, N.Y. 11779

[21] Appl. No.: 385,198

[22] Filed: Jul. 26, 1989

[51] Int. Cl.[5] ..... B01F 3/04

[52] U.S. Cl. ..... 55/385.1; 55/466; 261/111; 98/122

[58] Field of Search ..... 261/DIG. 11, 111; 55/385.1, 466; 98/122, 83

[56] References Cited

U.S. PATENT DOCUMENTS

| | | | |
|---|---|---|---|
| 612,383 | 10/1898 | Dean | 261/DIG. 11 |
| 755,254 | 3/1904 | Struhs | 98/122 |
| 912,823 | 2/1909 | Dehn | 98/122 |
| 941,668 | 11/1909 | Williams | 98/122 |
| 1,280,047 | 9/1918 | Kurtz | 98/122 |
| 1,452,259 | 4/1923 | Snell | 55/DIG. 19 |
| 2,775,310 | 12/1956 | Shelton | 261/DIG. 11 |
| 3,365,909 | 1/1968 | Brainard | 261/DIG. 46 |
| 4,192,832 | 3/1980 | Goettl | 261/DIG. 46 |
| 4,573,490 | 3/1986 | Kaletsky | 261/DIG. 46 |

FOREIGN PATENT DOCUMENTS

| | | | |
|---|---|---|---|
| 556291 | 9/1943 | United Kingdom | 261/DIG. 11 |

*Primary Examiner*—Tim Miles

[57] ABSTRACT

A device for preventing condenser water carryover and makeup water spray from going down the overflow drain but permits overflowing condenser water to go down the overflow drain. The device is removably installed into the top of the overflow drain.

2 Claims, 1 Drawing Sheet

COOLING TOWER OVERFLOW DRAIN CAP

BACKGROUND OF THE INVENTION

1. Field of Invention

The invention relates generally to a device that allows overflowing condenser water down the overflow drain, but does not allow carryover of condenser water or makeup water spray to go down the overflow drain.

2. Description of the Prior Art

Cooling tower overflow drains are left open. The problem with this is that condenser water carryover and makeup water spray go down the overflow drain. This loss of condenser water is costly. This invention eliminates this problem.

SUMMARY OF THE INVENTION

The invention is a cooling tower overflow drain cap which allows any overflowing condenser water down the overflow drain, but does not let any carryover or makeup spray down the overflow drain. It is the object of this invention to provide an inexpensive device which will allow more efficient use of a cooling tower. That will save on costly water treatment and makeup water.

DESCRIPTION OF THE PREFERRED EMBODIMENT

Figure 1:
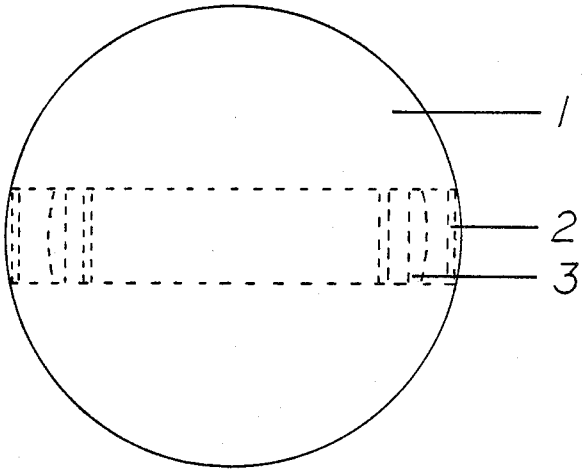
FIG. 1 is a top view showing cooling tower overflow drain cap.
Figure 2:
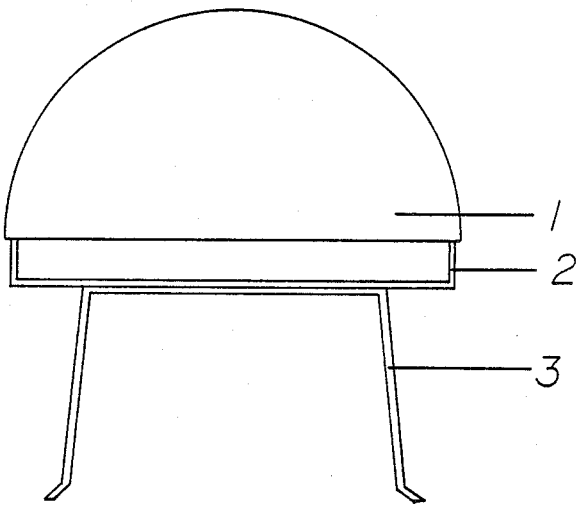
FIG. 2 is a side view showing cooling tower overflow drain cap.

Referring to FIGS. 1 and 2, an embodiment of the cooling tower overflow drain cap is shown. In this embodiment, the cap 1 comprises a stop member 2 and retention leg members 3. The retention leg members 3 must be compressed to be installed into the overflow drain. Installation is complete when stop member 2 is flush to the overflow drain. This invention can be made to fit any size overflow drain. This invention may be constructed of any non-corrosive material. The embodiment of this invention would function to keep a proper level of condenser water in the cooling tower in the on or off modes.

I claim:

1. Cooling tower overflow drain cap which comprises:

(A) a cap which prevents condenser carryover and makeup spray loss down the overflow drain, and (B) a stop member which holds the cap at a proper distance from the overflow drain permitting overflowing condenser water down the overflow drain, and (C) retention leg members which when removably installed in the overflow drain holds the device in place for desired results, and (D) a cap which has a larger diameter than the drain pipe, shaped as a half hollow sphere, which can fit various size drain pipes, and (E) a stop member which is connected to the cap, which the bottom surface of the stop member makes contact with the top edge of the drain pipe, means for support of the cap bottom edge above the upper edge of the drain pipe, and means for stopping the movement of the cap in a downward direction, which can fit various size drain pipes, and (F) retention leg members which are connected to the bottom surface of the stop member, which each leg member angle outwardly from the bottom surface of the stop member, which at the bottom of the retention leg members have an angle protruding out, which edge conforms to the inner surface of the drain pipe, means for keeping the cap centric to the drain pipe, and means for holding the cap in the inverted position with the stop member bottom surface flush against the top edge of the drain pipe, which does not permit movement, which can fit various size drain pipes.

2. Cooling Tower Overflow Drain Cap as recited in claim 1, which comprises:

(A) a cap constructed of a non-corrosive material, and (B) a stop member constructed of a thin flat non-corrosive material, and (C) retention leg members constructed of a thin flat elastic non-corrosive material, means for continous tension of the leg members when compressed and installed into the drain pipe.

* * * * *